US008056178B2

(12) United States Patent
Bar-Noy et al.

(10) Patent No.: US 8,056,178 B2
(45) Date of Patent: Nov. 15, 2011

(54) MOP WITH RECEPTACLE

(75) Inventors: Haim Bar-Noy, Derry, NH (US); Jay Hutchison, Racine, WI (US); James M. Scolaro, Racine, WI (US); Glenn N. Weaver, Racine, WI (US); Ronald R. Dir, Sturtevant, WI (US)

(73) Assignee: Diversey, Inc., Sturtevant, WI (US)

( * ) Notice: Subject to any disclaimer, the term of this patent is extended or adjusted under 35 U.S.C. 154(b) by 477 days.

(21) Appl. No.: 11/814,295

(22) PCT Filed: Jan. 24, 2006

(86) PCT No.: PCT/US2006/002340

§ 371 (c)(1),
(2), (4) Date: Feb. 4, 2010

(87) PCT Pub. No.: WO2006/081205

PCT Pub. Date: Aug. 3, 2006

(65) Prior Publication Data

US 2010/0125964 A1 May 27, 2010

Related U.S. Application Data

(60) Provisional application No. 60/647,062, filed on Jan. 26, 2005, provisional application No. 60/723,098, filed on Oct. 3, 2005.

(51) Int. Cl.
*A47L 13/20* (2006.01)

(52) U.S. Cl. ..... 15/257.1; 15/257.2; 15/221; 15/105

(58) Field of Classification Search ..... 15/257.1, 15/257.2, 105, 171, 159.1, 221
See application file for complete search history.

(56) References Cited

U.S. PATENT DOCUMENTS

| | | | | |
|---|---|---|---|---|
| 139,474 | A | | 6/1873 | Palmer |
| 429,704 | A | | 6/1890 | Solberg |
| D31,183 | S | | 7/1899 | Gerwig ..... D32/74 |
| 1,852,114 | A | | 4/1932 | Green |
| 1,960,210 | A | | 5/1934 | McCormick |
| 2,174,113 | A | | 9/1939 | Thienel |
| 2,265,289 | A | | 12/1941 | Kendall |
| 2,288,714 | A | | 7/1942 | Jones |
| 2,306,944 | A | * | 12/1942 | Gray ..... 15/231 |
| 2,377,118 | A | | 5/1945 | Weisman |
| 2,389,736 | A | | 11/1945 | Muise |
| 2,394,855 | A | | 2/1946 | Gould |

(Continued)

FOREIGN PATENT DOCUMENTS

| | | |
|---|---|---|
| CN | 2377991 | 5/2000 |

(Continued)

*Primary Examiner* — Shay Karls
(74) *Attorney, Agent, or Firm* — Gregory S. Bollis

(57) ABSTRACT

Some aspects of the present invention are related to a mop and/or mop head that allows larger debris to pass over at least a portion of the mop head and into a receptacle of the mop head. In some embodiments, the mop head and the receptacle are integrally formed. The mop has debris collecting material coupled to the mop head to collect dust, dirt, and other relatively small debris as the mop moves over a floor. In one particular embodiment, the debris collecting material is a non-woven material. The debris collecting material of the mop can be connected to the mop many different ways. However, in some embodiments, the material is connected via several projections extending from a top surface of the mop head. The projections pass through apertures in the dust collecting material.

24 Claims, 10 Drawing Sheets

U.S. PATENT DOCUMENTS

| | | | | |
|---|---|---|---|---|
| 2,733,468 | A | 2/1956 | Haber | |
| 2,767,650 | A | 10/1956 | Yunker et al. | |
| 2,816,311 | A | 12/1957 | Gasper et al. | |
| 2,999,259 | A | 9/1961 | Polner | 15/104.8 |
| 3,056,993 | A | 10/1962 | Lewis | 15/310 |
| 3,116,574 | A | 1/1964 | Ciesielski | |
| 3,150,664 | A | 9/1964 | Noel | |
| 3,221,354 | A | 12/1965 | Noyes | |
| 3,324,494 | A | 6/1967 | Vosbikian | 15/105 |
| 3,359,206 | A | 12/1967 | Cratsa | |
| 3,485,349 | A | 12/1969 | Chaney, Jr. | |
| 3,655,501 | A | 4/1972 | Tesch | |
| 3,733,636 | A | 5/1973 | Osadsky | 15/111 |
| 3,734,277 | A | 5/1973 | Bucalo | |
| 3,944,694 | A | 3/1976 | McQueary | |
| 3,948,126 | A | 4/1976 | Wolfberg et al. | 83/37 |
| 3,977,452 | A | 8/1976 | Wright | |
| RE29,052 | E | 11/1976 | Bucalo | |
| 4,078,865 | A | 3/1978 | Moser | |
| 4,142,334 | A | 3/1979 | Kirsch et al. | |
| 4,271,640 | A | 6/1981 | Gadbois et al. | |
| 4,335,731 | A | 6/1982 | Bora, Jr. | |
| 4,397,754 | A | 8/1983 | Collishaw et al. | |
| 4,490,895 | A | 1/1985 | Lin | |
| 4,670,962 | A | 6/1987 | Giallourakis | |
| 4,816,320 | A | 3/1989 | St. Cyr | |
| D300,905 | S | 5/1989 | Perkins | D9/415 |
| 4,951,341 | A | 8/1990 | Shears | |
| 4,998,984 | A | 3/1991 | McClendon | |
| 5,012,542 | A | 5/1991 | Lynn | 15/1 |
| D323,940 | S | 2/1992 | Murphy et al. | D4/116 |
| 5,092,699 | A | 3/1992 | Silvenis | 401/21 |
| 5,337,426 | A | 8/1994 | Matusewicz et al. | |
| 5,346,430 | A | 9/1994 | Baxter | |
| 5,426,809 | A | 6/1995 | Muta | |
| 5,461,749 | A | 10/1995 | Ahlberg et al. | |
| 5,469,594 | A | 11/1995 | Nolte | 15/121 |
| 5,675,911 | A | 10/1997 | Moser | |
| 5,694,659 | A | 12/1997 | Merrion | |
| 5,884,355 | A | 3/1999 | De Guzman | |
| 6,161,242 | A | 12/2000 | Cabrero Gomez et al. | |
| 6,202,250 | B1 | 3/2001 | Kenmochi et al. | 15/231 |
| 6,253,408 | B1 | 7/2001 | Feld et al. | |
| D449,911 | S | 10/2001 | Goodman | D32/74 |
| 6,380,151 | B1 | 4/2002 | Masters et al. | |
| 6,418,827 | B1 | 7/2002 | Bussey, III et al. | |
| D461,610 | S | 8/2002 | Perelli | D32/74 |
| D468,879 | S | 1/2003 | Perelli | D32/74 |
| 6,698,058 | B2 * | 3/2004 | Cann | 15/257.1 |
| D502,299 | S | 2/2005 | Junghans | D32/35 |
| 6,887,524 | B2 | 5/2005 | Aouad et al. | |
| D509,035 | S | 8/2005 | Libman et al. | D32/74 |
| 6,989,075 | B1 | 1/2006 | Kao et al. | |
| D533,356 | S | 12/2006 | Van Landingham, Jr. | D4/199 |
| 7,350,256 | B2 | 4/2008 | Benjamin et al. | |
| 2003/0044569 | A1 | 3/2003 | Kacher et al. | |
| 2003/0164176 | A1 * | 9/2003 | Arbon | 134/6 |
| 2003/0167588 | A1 | 9/2003 | Perelli et al. | 15/257.7 |
| 2004/0011382 | A1 | 1/2004 | Kingry et al. | 134/6 |
| 2004/0134004 | A1 | 7/2004 | Kaleta | 15/104.002 |
| 2005/0155627 | A1 | 7/2005 | Bober et al. | 134/6 |

FOREIGN PATENT DOCUMENTS

| | | |
|---|---|---|
| CN | 1316225 | 10/2001 |
| CN | 2548544 | 5/2003 |
| GB | 742754 | 1/1956 |
| GB | 1214543 | 12/1970 |
| JP | 09-327427 | 12/1997 |
| WO | WO 00/78513 A1 | 12/2000 |

* cited by examiner

MOP WITH RECEPTACLE

CROSS-REFERENCE TO RELATED APPLICATIONS

This claims priority to U.S. provisional patent application No. 60/647,062, filed on Jan. 26, 2005, and U.S. provisional patent application No. 60/723,098, filed on Oct. 3, 2005. The contents of both patent applications are hereby incorporated by reference.

BACKGROUND OF THE INVENTION

Many different floor types are cleaned with mops and more particularly dust mops. For example, dust mops are generally used on vinyl floors, wood floors, concrete and stone floors, tile floors, and the like. Dust mops are used in many businesses, homes, schools, governmental buildings and the like. However, the exact type of dust mop and size of dust mop generally depends upon the size of the area to be cleaned.

One type of conventional dust mop features a mop head comprising a large number of braided strands extending from the mop head. These strands capture dust, dirt, and most fine debris. However, such mop heads are relatively expensive. Due to the expense, these types of mop heads are generally not considered to be disposable. Further, it is quite costly to clean and maintain the mop head of this type of dust mop.

Relatively recently, disposable dust mops have been found to be a lower cost alternative to the conventional braided strand dust mop. Generally, these types of dust mops have an elongated mop head that is adapted to receive a disposable sheet of material. The sheet of material generally is attached to the mop head by hook and loop fasteners or by pushing portions of the material into an aperture having elastic fingers extending into the aperture. Once the sheet of material is attached to the mop head, the mop is passed along the floor to gather dust, dirt, and other fine debris similar to the conventional braided strand dust mop. Once mopping is complete, the sheet of material can be removed from the mop head and disposed of.

Both of these types of dust mops are particularly suited for removing dust and other similar small debris from these surfaces. However, larger debris, such as candy wrappers, sheets of paper, soda containers, and the like, is generally not removed very efficiently with a dust mop. Although larger debris can be pushed by the mop from its initial location, this larger debris can tend to ride over the top of the dust mop or work its way past the edge of the dust mop. Accordingly, mop operators must manually pick-up each item of the larger debris upon this occurrence or allow the larger debris to remain on the floor. Additionally, once this larger debris is manually picked-up, the operator of the mop must either store the debris while continuing to mop or stop mopping to dispose of the debris.

SUMMARY OF THE INVENTION

Some aspects of the present invention are related to a mop and/or mop head that allows larger debris to pass over at least a portion of the mop head and into a receptacle of the mop head. In some embodiments, the receptacle is positioned on top of the mop head. Furthermore, in some embodiments, the mop head and the receptacle are integrally formed. In some embodiments, the receptacle extends substantially the entire length of the mop head. In such embodiments, portions of the receptacle can be shaped to help direct the debris to a central portion of the receptacle that is partially covered. In other embodiments, the receptacle only extends across a portion of the mop head.

The receptacle of some embodiments can be designed to support the pole extending from the mop in an inclined position, which will allow for easier grasping by the operator. The receptacle can also have a portion that allows the pole to lie substantially parallel to the mop head.

The mop of some embodiments utilizes a non-woven material positioned below the mop head to collect dust, dirt, and other relatively small debris. Additionally, this material has some liquid absorbing capabilities to absorb some spills and drips. Other embodiments, however, can use other materials, such as woven materials, cloth, paper products, microfiber, and the like. The debris collecting material of the mop can be connected to the mop many different ways. In some embodiments, the material is connected via several projections extending from a top surface of the mop head. The material in some embodiments can have slits that are positioned to receive those projections.

Some embodiments of the invention are also directed toward a material converting device adapted to produce the material. The material converting device includes a roller having perforation knives and additional knives for cutting slits into the material for receiving the projections from the mop.

Further aspects of the present invention, together with the organization and operation thereof, will become apparent from the following detailed description of the invention when taken in conjunction with the accompanying drawings.

DETAILED DESCRIPTION

Figure 1:
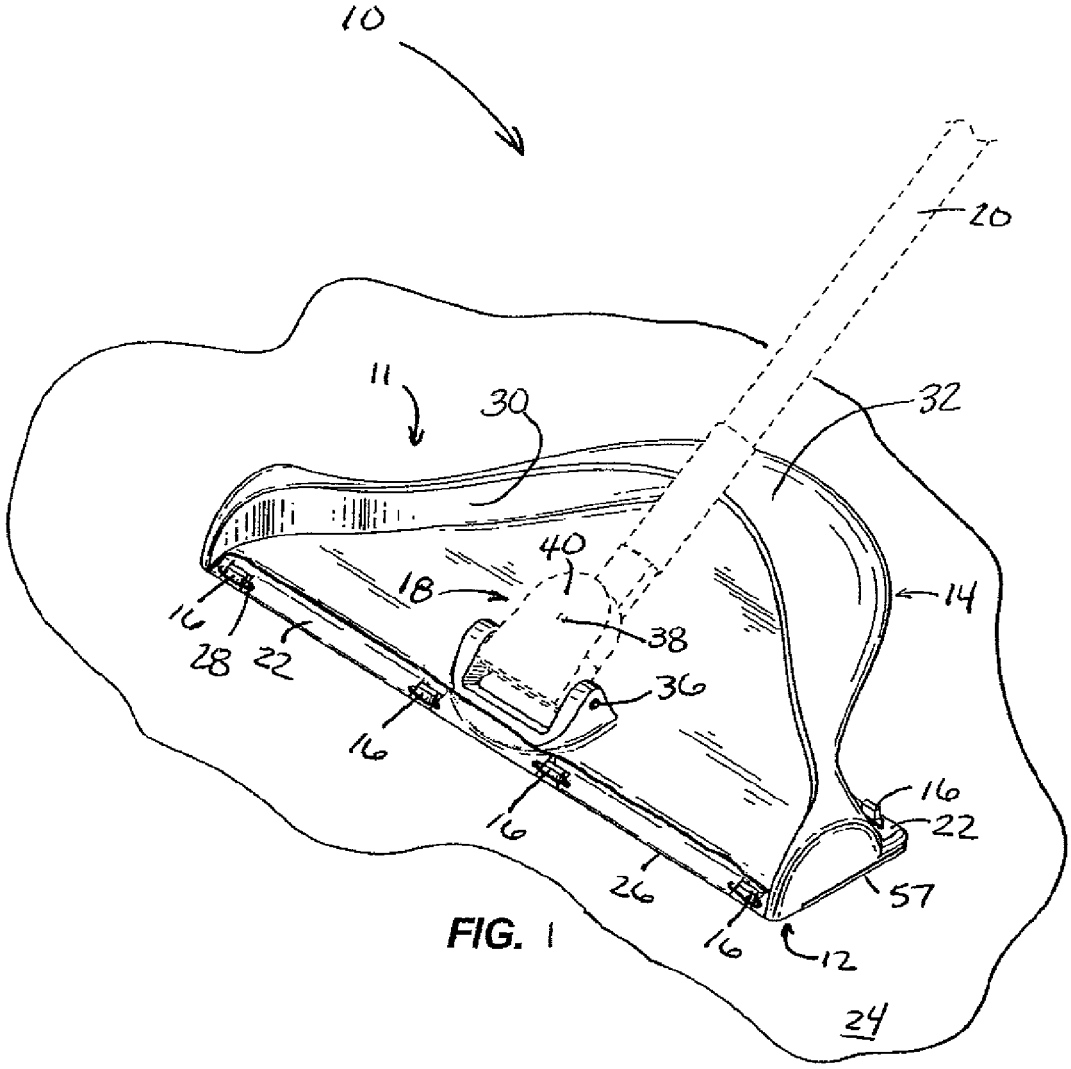
FIG. 1 is a perspective view of a mop with a receptacle embodying aspects of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising," or "having" and variations thereof herein is meant to encompass the items listed thereafter and equivalents thereof as well as additional items. The terms "mounted," "connected," and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Finally, as described in subsequent paragraphs, the specific mechanical configurations illustrated in the drawings are intended to exemplify embodiments of the invention. Accordingly, other alternative mechanical configurations are possible, and fall within the spirit and scope of the present invention.

Figure 2:
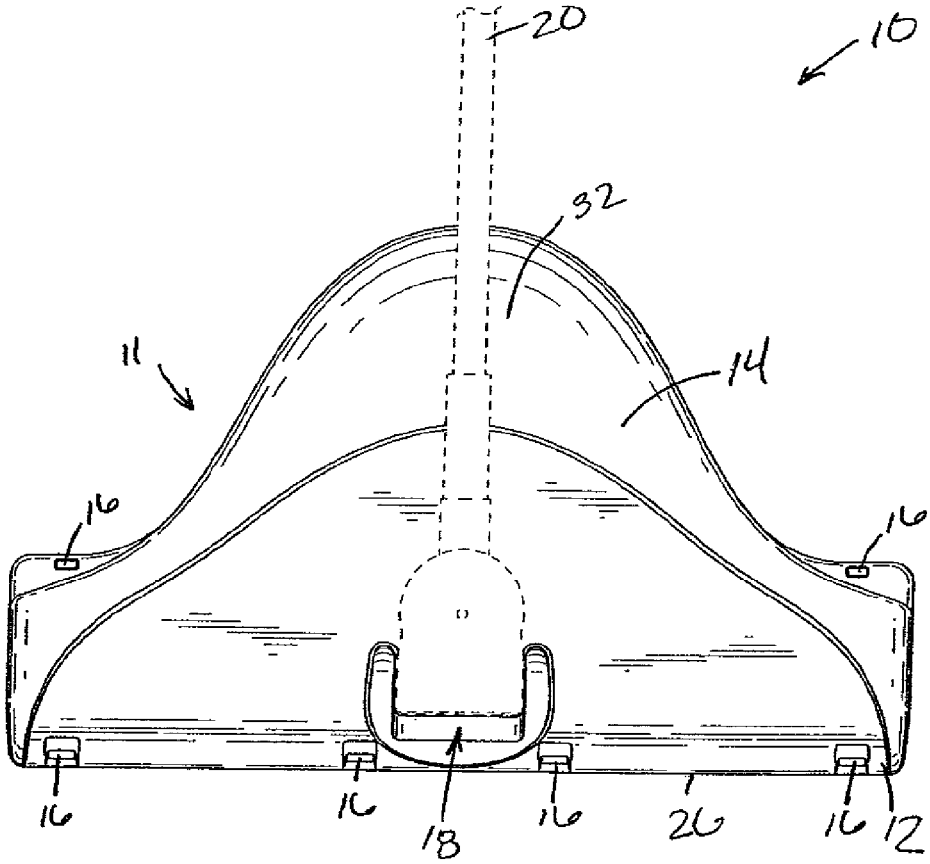
FIG. 2 is a top view of the mop shown in FIG. 1.
Figure 3:
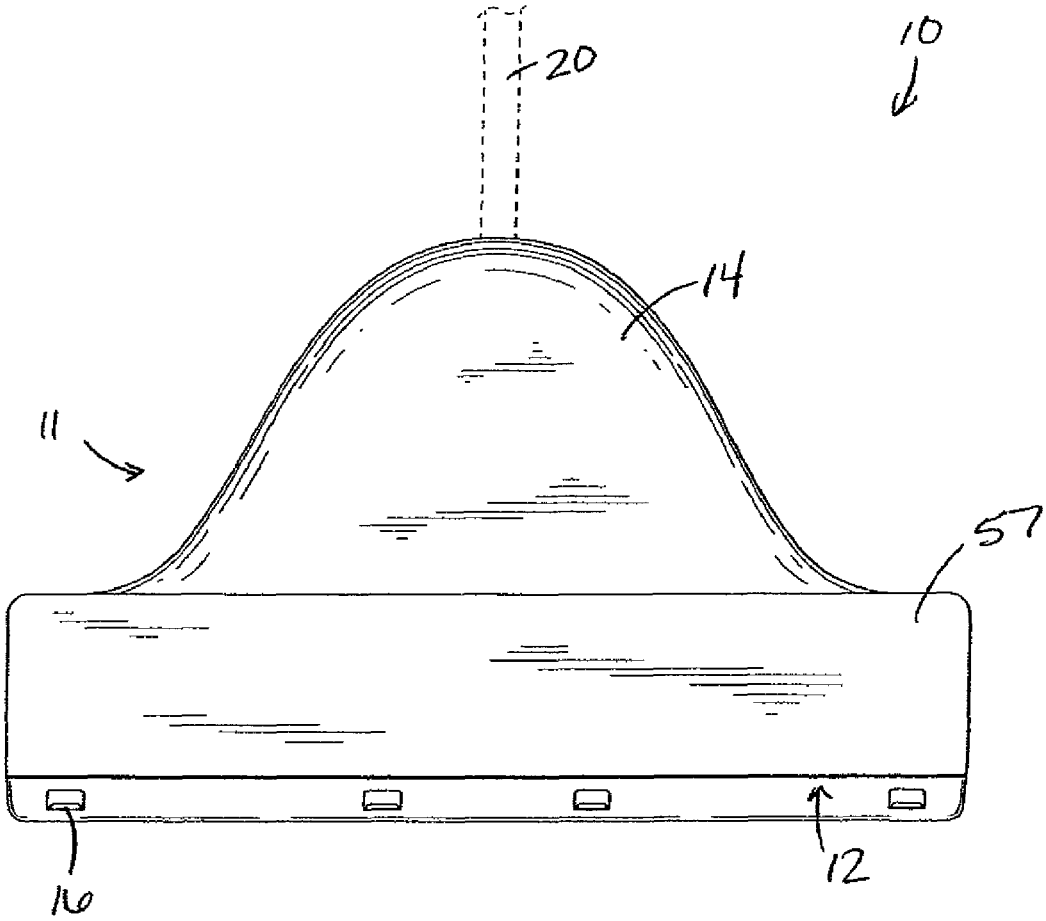
FIG. 3 is a bottom view of the mop shown in FIG. 1.
Figure 4:
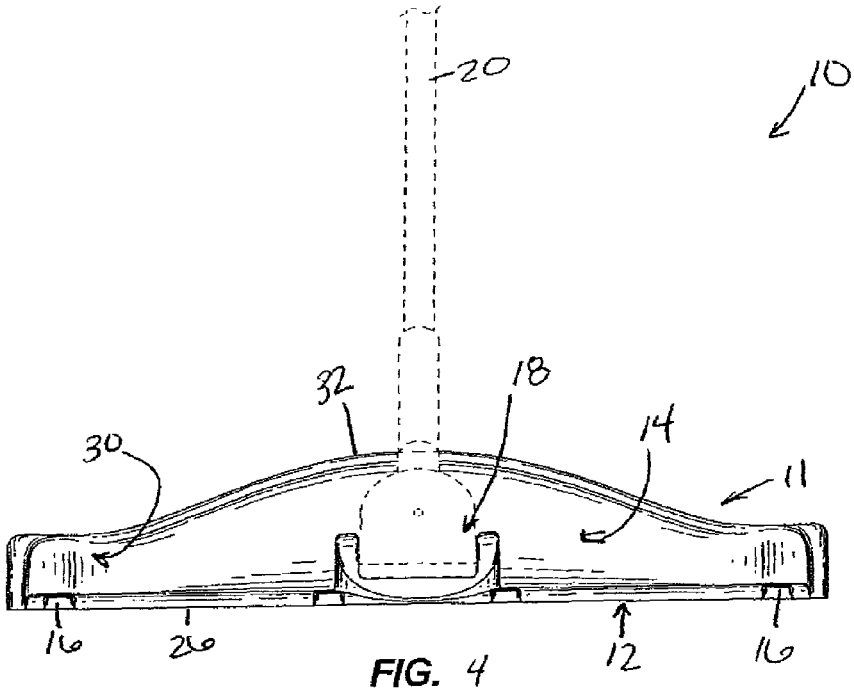
FIG. 4 is a front view of the mop shown in FIG. 1.
Figure 5:
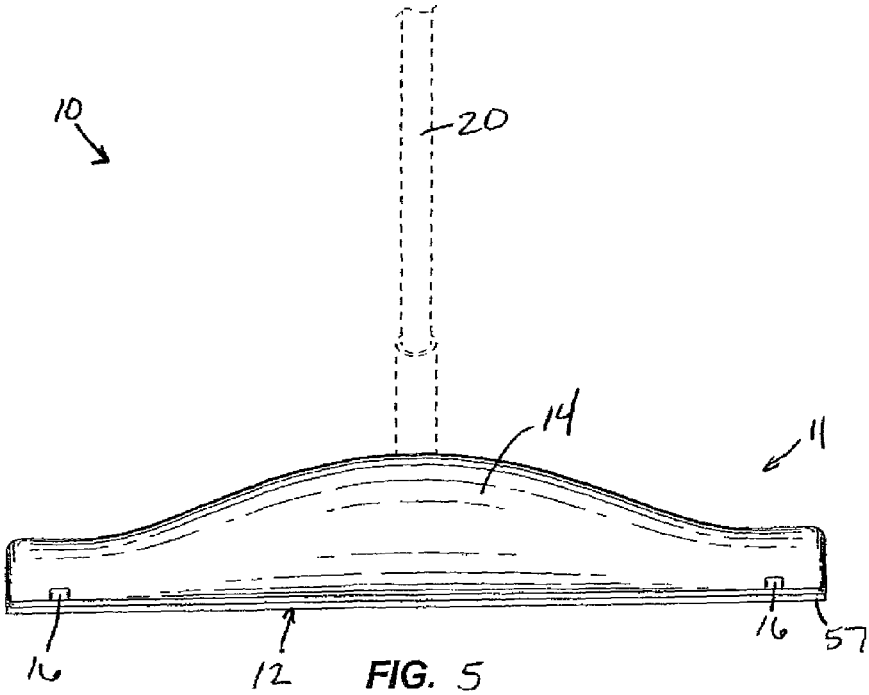
FIG. 5 is a rear view of the mop shown in FIG. 1.
Figure 12:
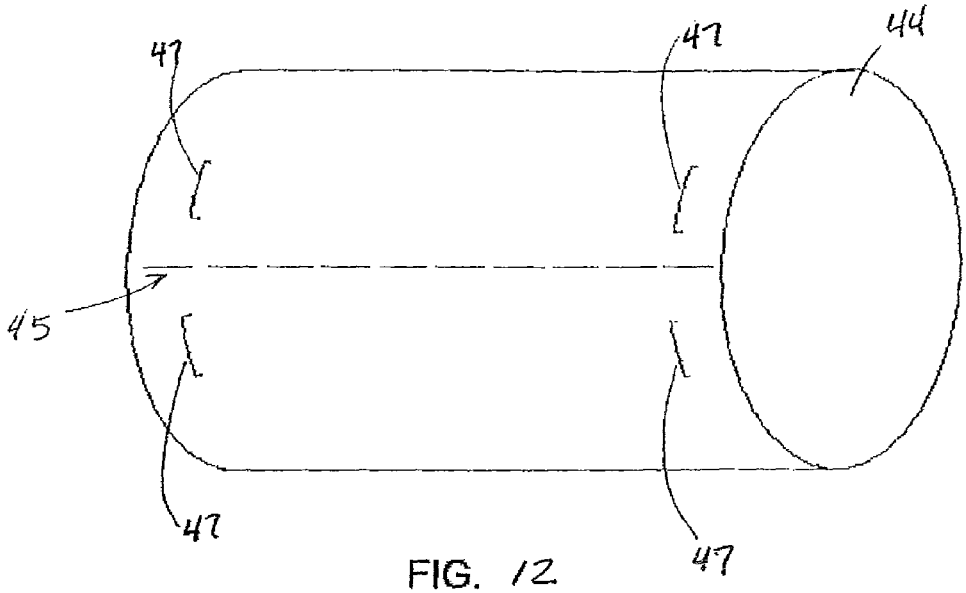
FIG. 12 is a perspective view of a roll for converting debris collecting material.

A mop 10 comprising a mop head 11 that embodies aspects of the invention is illustrated in FIGS. 1 and 2. As illustrated, the mop head 11 has a base 12, a receptacle 14 coupled to the base 12, projections 16 coupled to the base 12, and a pivot assembly or swivel 18 coupled to the base 12. A pole, rod, or other extension member 20 is received within a portion of the pivot assembly 18 as shown in FIG. 12. Finally, a debris collecting material 22 can be coupled to base 12 or positioned between the base 12 and a floor 24.

The base 12 of the illustrated mop head 11 is relatively thin. In other words, the base 12 does not extend away from a floor a significant distance. In one particular embodiment, the base 12 has a height of less than one centimeter. More particularly, the base 12 has a height of about 0.6 centimeters. This allows relatively large debris to ride up over the front edge 26 of the mop head 11 to be received by the receptacle. However, in other embodiments, the base 12 can have other dimensions.

The front edge 26 of the base 12 can be tapered (as shown) to allow debris to pass over the front edge 26 more easily. For example, the front edge 26 can have an initial height that is about one millimeter or less. This height can gradually increase progressing away from the front edge 26. This taper can extend across the entire base 12 or only a portion of the base 12. In one embodiment, the taper extends for about 1.5 millimeters.

Figure 8:
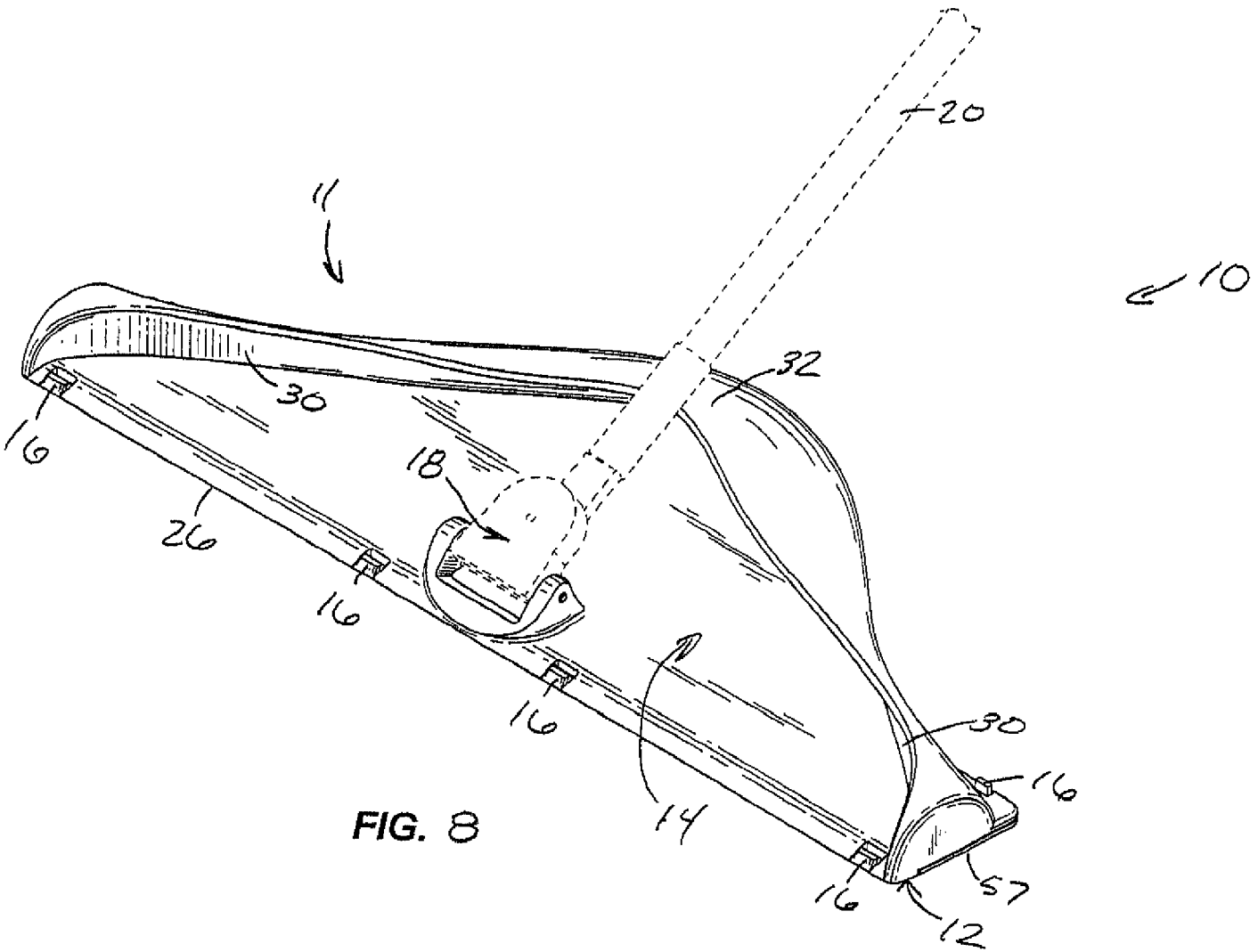
FIG. 8 is a perspective view of a mop with a receptacle embodying aspects of the invention.
Figure 9:
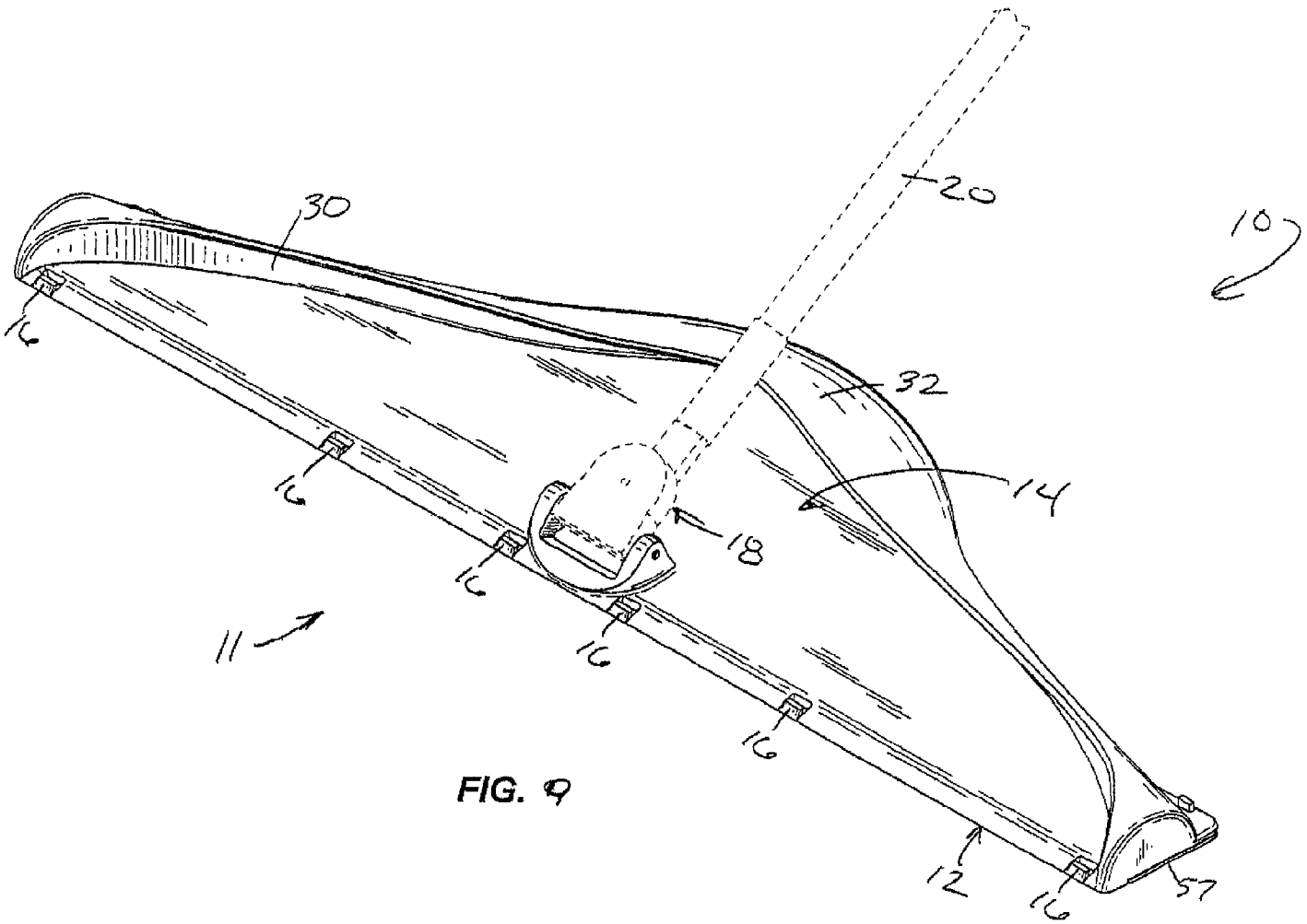
FIG. 9 is a perspective view of a mop with a receptacle embodying aspects of the invention.

The base 12 can have substantially any width (i.e., extend in the transverse direction). In some embodiments, the base 12 can have a width of one foot or greater. In other embodiments, the base 12 can have a width of about two feet or greater. Additionally, in some applications, the base can have a width of about four feet or greater. FIGS. 1, 8, and 9 illustrate various embodiments having different lengths.

As best shown in FIGS. 1, 2, 4, and 5, several projections 16 extend from the base 12. As illustrated, the projections 16 are positioned on the top surface of the base 12. Specifically, many of the projections 16 are positioned adjacent the front edge 26 of the base 12. More specifically, these projections 16 adjacent the front edge can extend from the tapered section of the front edge 26 of the base 12. In other embodiments, the projections 16 (if any) can be positioned in other locations. For example, the projections 16 can be positioned further back from the front edge 26 of the base 12. Additionally, the projections 16 can extend from the front edge 26 in a direction that is substantially parallel to the bottom surface of the base 12. Additionally, as shown in the illustrated embodiments, such projections can extend from a back or rear surface of the base 12.

The projections 16 are positioned at spaced apart intervals. For example, in some embodiments, the projections 16 are about four inches or greater apart. In other embodiments, the projections 16 are about 8 inches or greater apart. In yet other embodiments, the projections 16 are less than about 12 inches apart. In the illustrated embodiments, the projections are generally positioned within any multiple of 7.25 inches apart, 12 inches apart, or 4.75 inches apart (on center).

The projections 16 are shaped to receive and hold the debris collecting material 22. Specifically, the projections are received within apertures or slots 28 within the debris collecting material 22. The projections 16 can have a variety of shapes to hold the debris collecting material 22. For example, the projections 16 can be straight or have a hook shape, L-shape, or the like. The projections 16 provide an area where the apertures 28 of the debris collecting material 22 rest while the mop is being used.

Although the illustrated embodiment utilizes projections 16 to retain the debris collecting material 22, other embodiments can utilize other features to retain the debris collecting material 22. For example, clips, hook and loop fasteners, snaps, buttons, elastic fingers or recesses, and the like can be used to retain the debris collecting material 22.

The debris collecting material 22 can be made from a variety of different materials. Some embodiments utilize a non-woven material to collect dust, dirt, and other relatively small debris. Non-woven materials have proven to also absorb some liquids as well, which can be beneficial for cleaning up small spills and drips. Other embodiments, however, can use other materials, such as woven materials, cloth, paw products, microfiber, and the like. Generally, the materials should have adequate dust collecting properties. The debris collecting material 22 can be disposable or reusable, as well.

The debris collecting material 22 is positioned below the mop head 11 to collect dust, dirt, and other relatively small debris during use of the mop 10. The debris collecting material 22 of the mop 10 can be connected to the mop 10 many different ways. In some embodiments, the material 22 is connected via the projections 16 extending from a top surface of the mop head 11. However, as discussed above, the debris collecting material 22 can be connected other ways. In some embodiments, the material 22 can be held in place via static electric forces and the like. In other embodiments, the weight of the mop head 11 may be the only thing holding the debris collecting material 22 in place.

Figure 10:
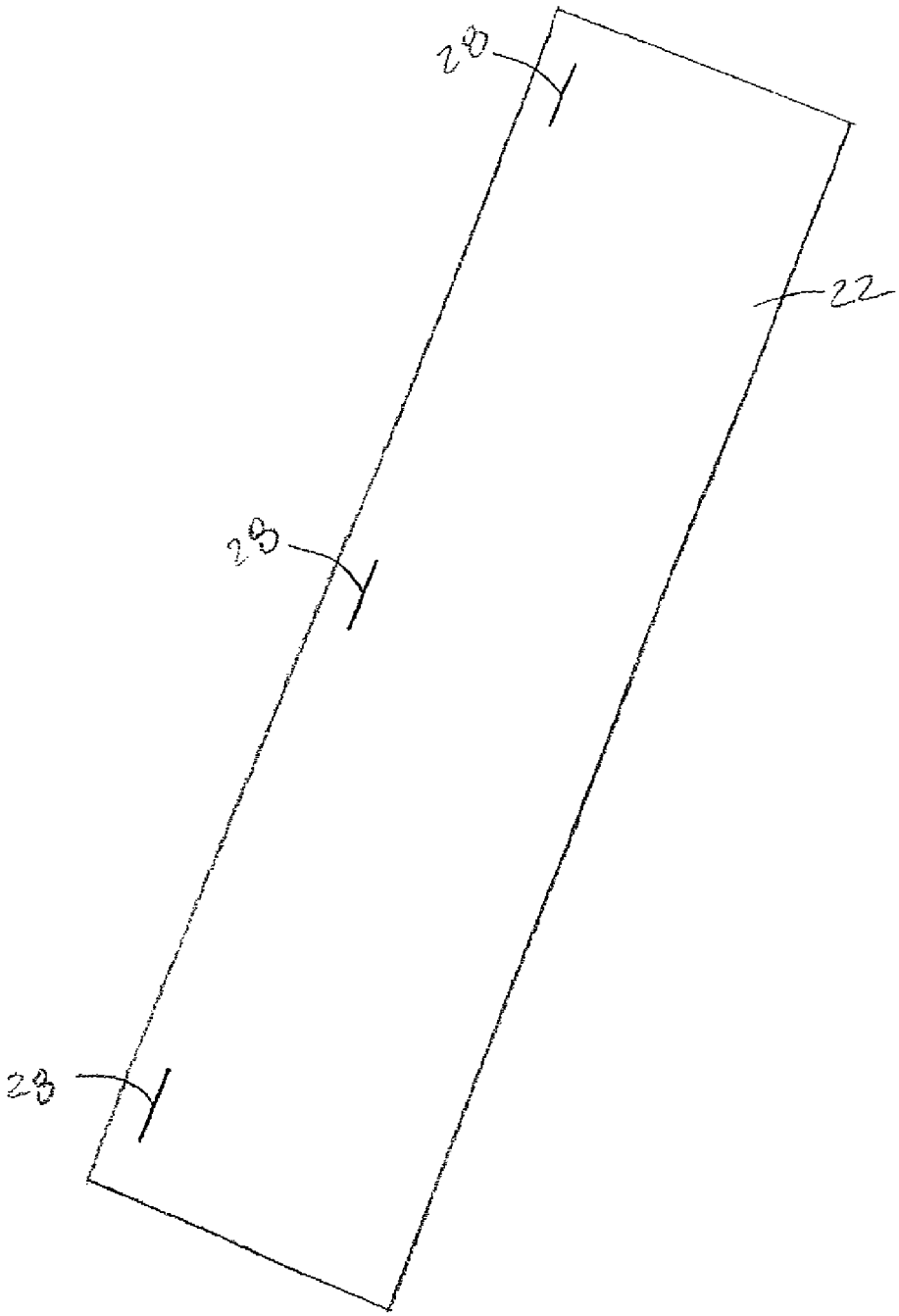
FIG. 10 is a top view of debris collecting material embodying aspects of the present invention.
Figure 11:
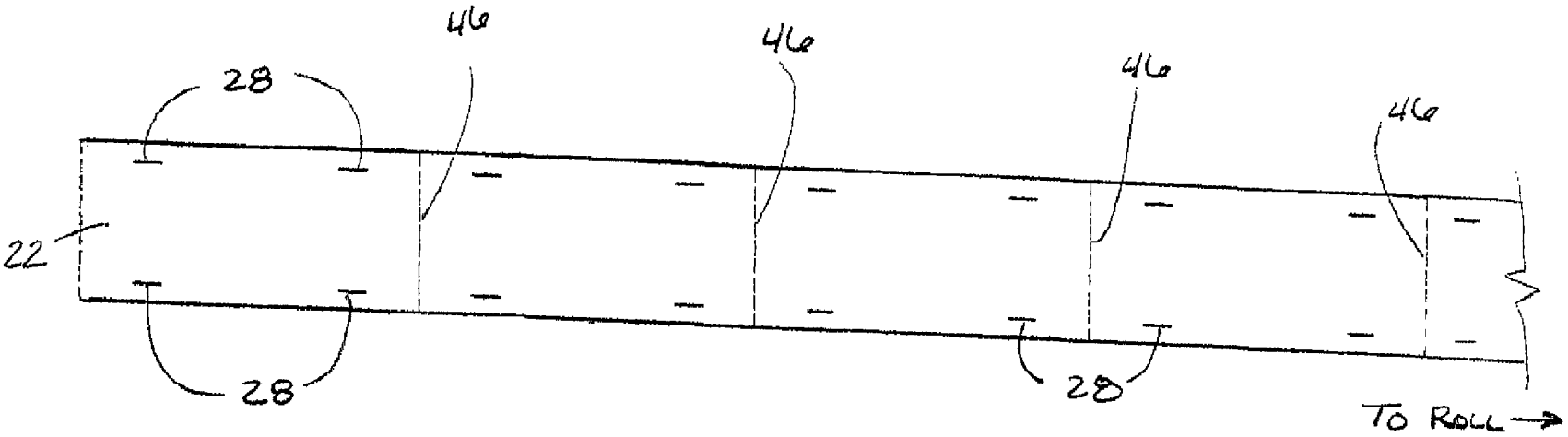
FIG. 11 is a top view of debris collecting material embodying aspects of the present invention.

As shown in FIGS. 1, 10, and 11, the illustrated debris collecting material 22 has apertures 28 that are spaced apart corresponding to the projections 16 on the mop at 11. These apertures 28 are positioned adjacent an edge of the debris collecting material 22. The apertures 28 are received on the projections to hold the material 22 in place.

When the material 22 is connected to the mop head 11, the material 22 covers a portion of the top surface of the mop head 11, substantially the entire front edge 26 of the mop head 11, and at least a portion of the bottom surface of the mop head 11. In the illustrated embodiments, the material 22 also extends over a rear edge of the base. In some embodiments, the material 22 does not need to be connected to the rear edge of the base. The portion of the material 22 on the bottom surface of the mop head 11 and on the front edge of the mop head performs much of the small debris collecting functions.

In alternative embodiments, one or more loops of material can extend from the debris collecting material 22 to be received on the projections 16. Accordingly, only the loops will extend over the front edge of the mop head 11, opposed to a portion of the debris collecting material 22 as illustrated.

The receptacle 14 is positioned adjacent the base 11 to catch larger debris as it passes over the base 11. Specifically, the illustrated receptacle 14 is coupled to and extends from the base 12. In some embodiments, such as the illustrated embodiments, the receptacle 14 is integrally formed with base 11.

The receptacle 14 can have a variety of shapes that can catch and retain debris. For example, in some embodiments, the receptacle 14 can have walls 30 that extend in a generally inclined direction from the base 12 along a portion of the perimeter of the base 12 or portions thereof. In other words, the receptacle 14 can be shaped somewhat like a dust pan.

In the illustrated embodiments, the receptacle 14 extends substantially the entire length of the mop head 11. Particularly, portions of the receptacle or walls 30 of the receptacle 14 extend substantially from the transverse ends of the base 12. These portions of the receptacle extend upward from the base 12 and backwards from the base 12. These portions extend backwards along a curved path and ultimately meet together to at least partially define the receptacle 14. The path of these walls can be configured to help direct the debris to a central portion of the receptacle 14 that is partially covered.

As the walls 30 extend backwards along the curved path they can also increase in height. This can allow more material to gather within these portions of the receptacle. Also, the reduced height portions of the receptacle allow the ends of the mop head 11 to reach under cantilevered objects such as cabinets, lockers, product displays, and the like.

The receptacle 14 in the illustrated embodiment is further defined by a top 32 that extends from a portion of the walls 30. Specifically, in the illustrated embodiment, the top 32 is integrally formed with the walls of the receptacle 14. As illustrated, the top 32 of the illustrated embodiment does not extend over the entire mop head 11. However, in other embodiments, the top 32 (if any) can extend over more or less of the mop head 11. The top 32 defines a recess for gathering or capturing debris.

Figure 6:
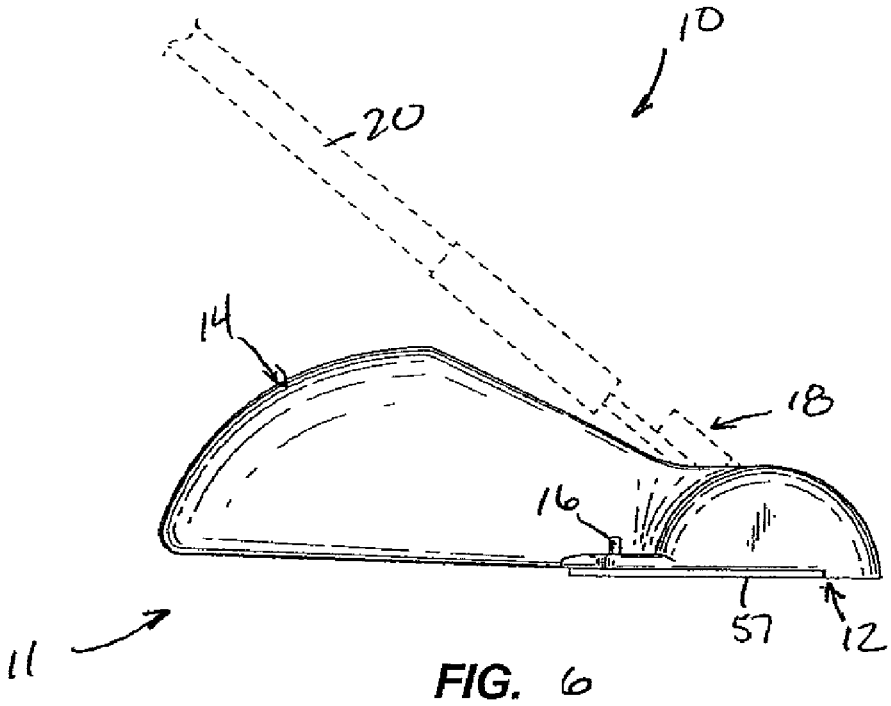
FIG. 6 is a side view of the mop shown in FIG. 1.
Figure 7:
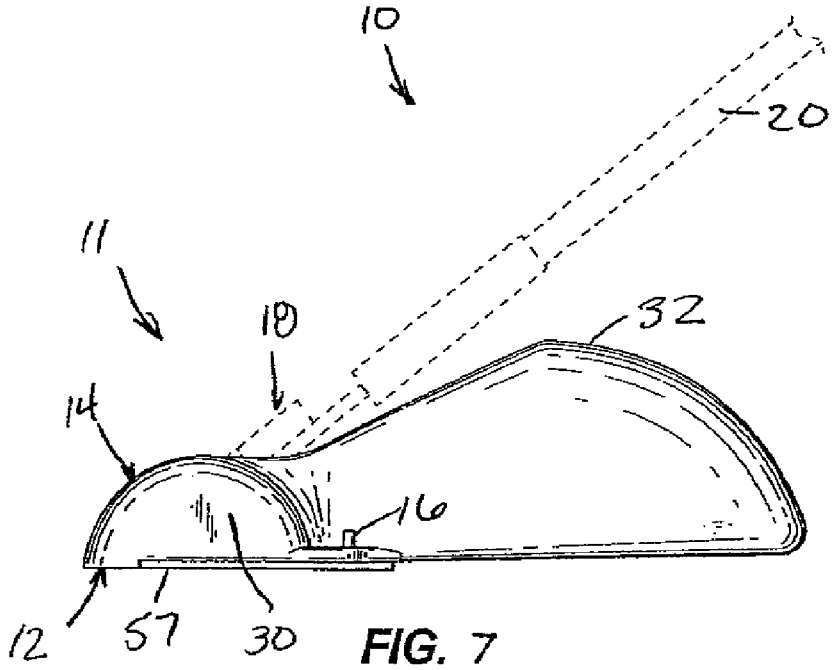
FIG. 7 is a side view of the mop shown in FIG. 1.

As best shown in FIGS. 6 and 7 the receptacle 14 can rest on the floor 24 during operation of the mop or can be elevated above the floor. If the receptacle 14 rests on the floor 24, the receptacle 14 can be made from resilient, low friction materials to prevent wear to the receptacle and scratching or other marking on the floor 24. Alternatively, portions of receptacle 14 in contact with the floor can be made from those materials, coated with those materials, or otherwise protected. However, as shown in FIGS. 6 and 7, the receptacle 14 can be recessed such that it is raised from the floor 24 during use to protect against wear and scratching.

The receptacle 14 can have alternative constructions. For example, in some embodiments, the receptacle 14 only extends along a portion of the base 12. In other words, the walls of the receptacle 14 do not extend to the transverse ends of the base 12. Additionally, the receptacle of some embodiments does not need to be enclosed or made from rigid materials. Specifically, the receptacle can merely funnel or direct collected material along a path to ultimately be collected in a bag attached to the mop head. Furthermore, in some embodiments, the receptacle or portions thereof can be separated from the base 12 to allow the contents of the receptacle to be emptied.

In some embodiments, such as the illustrated embodiments, the base 12 is at least partially covered or formed from a relatively soft material 57, such as rubber, foam, or the like. This softer material can help prevent scratching of the floor finish if hard materials, such as sand and other materials are trapped beneath the mop head 11. In such a situation, the soft material 57 would deform slightly. This material can also reduce the amount of noise coming from the mop head as is passes along the floor.

A pivot assembly 18 is coupled to the mop head as illustrated in FIG. 1. The pivot assembly 18 can be constructed many different ways and connected to the mop head 11 at many different positions. The pivot assembly 18 allows the operator to manipulate the position of the mop head 11 on a floor with the pole 20. The pivot assembly 18 preferably allows many degrees of freedom.

This illustrated pivot assembly 18 utilized two hinges or pivots 36, 38 that are positioned such that their axes of rotation are normal to each other. One pivot 36 is connected to the base 12, while the second pivot 38 is coupled to an extension 40 of the first pivot 38. A member 42 extends from the second pivot 38 and is adapted to receive the pole 20. Other embodiments can utilize other pivot and swivel assemblies, such as ball and socket structures and the like.

Although the illustrated pivot assembly 18 extends from the base 12, it can extend from other portions of the mop head 11 as well. For example, in some embodiments, the pivot assembly 18 may be connected to a portion of the receptacle 14, such as the top, back, or inside surface.

As illustrated in FIG. 1, the receptacle 14 of some embodiments can be designed to support the pole 20 extending from the mop head 11 in an inclined position relative to the floor 24. This allows the pole 20 to rest in a position that is easier for the operator to grasp. However, if one desires to have the pole 20 lie substantially parallel to the base 12, the pole 20 can be rotated about ninety degrees in either direction (relative to the position shown in FIG. 1). In this position, the pole 20 can be pivoted downward such that it is not inclined with respect to the floor 24 (or is inclined relatively little compared to FIG. 1). This non-inclined position may allow for more convenient storage. The construction of the illustrated receptacle 14 allows the pole 20 to rest in these two positions (i.e., inclined and non-inclined relative to the floor). Specifically, as discussed above, the central portion of the receptacle 14 is raised and accordingly it can support the pole 20 in the inclined position. The outer extents of the receptacle 14 are not raised as much as the central portion. Accordingly, the height of the outer extents allows the pole 20 to lie substantially parallel to the mop head 11.

In operation, an operator would couple debris collecting material 22 to the mop head 11 before mopping a floor 24. The material 22 could be connected a variety of ways. In one particular embodiment, the debris collecting material 22 is slotted. The slots 28 of the debris collecting material 22 are received on projections 16 extending from the mop head 11. The projections 16 are positioned on a top surface of the mop head 11 adjacent the front edge of the mop head. Accordingly, due to this configuration, the debris collecting material is positioned partially over the top surface of the mop head when connected. The debris collecting material 22 is then folded around the front edge of the mop head 11 and a substantial portion of the material is positioned beneath the mop 11. A portion of the material 22, can then be wrapped over the back edge of the base and connected to projections extending from the back edge of the base.

Once the debris collecting material 22 is connected to the mop head 11, mopping operations can begin. Accordingly, the mop head 11 is positioned on a floor to be mopped and the mop head 11 is pushed along the floor 24. As the mop 10 is pushed, fine debris on the floor 24 such as dust, dirt, and the like is captured by the debris collecting material 22. Larger debris such as beverage containers, food wrappers, paper/paper products, pens, pencils, and other similarly sized items are captured by the receptacle 14. As described above, these larger items ride over the front edge 26 of the mop head 11 during mopping motions. Depending upon where these larger items pass over the front edge 26 of the mop head 11, the debris may or may not need to be redirected by the walls 30 of the receptacle 14 towards the center of the receptacle 14. Generally, the items passing over the front edge 26 of the mop head 11 near the transverse ends of the mop head may need to be directed as described above.

Once the receptacle 14 is full or mopping operations are complete, the receptacle 14 can be emptied and the debris collecting material 22 can be disposed of The receptacle 14 can be emptied by positioning the mop head 11 over a trash receptacle and tipping the mop head 11. The design of the illustrated mop head 11 allows the receptacle 14 to be emptied into relatively small trash receptacles. As described above, the walls 30 of the receptacle follow a curved path. The receptacle can be tipped such that the debris captured by the receptacle must flow along this path toward a trash receptacle. Accordingly, only the end of the mop head 11 needs to be positioned over a trash receptacle 14 to empty the receptacle on the mop head 11.

To dispose of the debris collecting material 22, the material 22 is simply removed from the mop head 11 and disposed of. The material 22 is removed by lifting the apertures 28 off of the projections 16. Once the material 22 is removed, it can be replaced with new material 22.

As described above, some embodiments of the mop come in a variety of sizes. For example, one embodiment is offered in twelve inch increments (i.e., 12 inch, 24 inch, 36 inch, 48 inch, etc.). Accordingly, the sheet material utilized to mop the floor needs to have apertures or slits corresponding to projection positions for each size of the mop. In some embodiments, the sheet material is specifically cut for each size mop (i.e., specific sheets only fit one size of mop). In other embodiments, such as the ones illustrated in FIGS. 10 and 11, the sheet material is cut to allow a single roll of sheet material to be used on any size mop.

As shown in FIG. 11, the web material of this embodiment has a pattern that repeats every twelve inches. In other words, the roll is perforated every twelve inches to allow a twelve inch sheet to be torn from the roll for a twelve inch mop. Further, various other lengths can be easily separated from the roll for mops of other incremental sizes. Within each of the twelve inch segments, the material is cut in the longitudinal direction adjacent the edge and ends of the perforated sheet. Four cuts or slits are provided near the corner of each sheet. The cuts for the slits are sized and positioned to be received on the fingers or projections of a twelve inch mop. In the illustrated embodiment, each slit is positioned about three-quarters of an inch from the longitudinal edge of the sheet material. Further, the slits are positioned on center within the sheet about seven and one-quarter inches apart. Also, each slit extends for about one inch. The illustrated material has a transverse length of about six inches.

When this roll of material is utilized for other sized mops, the material can be separated from the roll at the appropriate length to fit the mop. Once the material is separated, then the material can be placed on the mop by aligning the projections on the mop with corresponding slits in the material. For example, with a four foot mop, the projections on the end of the mop with line up with the slits on the end of the separated sheet material. Further, various slits along the longitudinal edge will line up with the other projections on the front edge of the mop.

The process and device for cutting or converting the sheet material will now be discussed. Paper and other web material converting machines are known in the art. Generally, the web of material is fed through or between two rollers or drums to emboss or perforate the material. U.S. Pat. No. 6,418,827 discusses one type of machine designed to perforate a roll of material. The teachings of this patent are hereby incorporated by reference.

The sheet material of the present invention can be perforated by the process discussed in the above patent or by other known perforating techniques. FIG. 12 shows a roll or drum 44 adapted to cut both the slits 28 in the sheet material in the longitudinal direction of the sheet material and the perforations 46 in the transverse direction of the sheet material 22. As illustrated, the drum has an axis of rotation. The drum is provided with a set of perforating knives 45 that extend in a line along the outer circumference of the drum in the axial direction. The perforating knives 45 should extend a sufficient distance along the length of the drum (i.e., the axial direction) to provide a perforation 46 across substantially the entire width or transverse direction of the web. The drum is also provided with knives 47 extending about a portion of the circumference of the drum. One set of knives 47 are positioned on either side of the perforation knives 45 to provide slits 28 in the material 22 in the longitudinal direction of the material. Assuming the roller is adapted to convert a single six inch section of the web material at a time, the cutting knives 47 should be positioned about three-fourths of an inch from each end of the roller. Further, these cutting knives 47 should also be positioned between about two and one-quarter inches and about two and one-half inches from the perforation knives. Other embodiments can position the knives differently. The measurements provided herein produce a web material that corresponds to the mops described herein.

The roller shown in the figures perforates and cuts one sheet of material per rotation. In other embodiments, the roller can be configured to perforate and cut multiple sheets per rotation. Further, the roll can be extended in length to allow multiple rollers to be cut and perforated at the same time from a single log.

In operation, an unperforated roll of web material is fed between the illustrated roll and another roll. The illustrated roller rotates while the material is fed through, which causes the knives to pass over the web material. As the knives pass over the web material, the web material is cut and perforated. As the web material passes by the roller, it can be wound up onto another roll.

In use, the proper amount of web material is unwound from the roll of web material and removed from the web material along a perforation. The material is then placed on the bottom of the mop and temporarily fixed to the mop by engaging the projections on the mop with the slits in the sheet material. For a twelve inch mop, one section of sheet material would be separated from the roll and connected to the mop via all four slits. For a twenty-four inch mop, two sections of web material can be removed from the roll of material along a perforation. The material can be connected the mop via the slits adjacent the end, as well as via the other two slits along the front edge. For a thirty-six inch mop, three section of web material can be removed along a perforation and connected to the mop. The slits adjacent the ends of the sheet material can be used to connect the web material to the ends of the mop and others along the front edge of the mop can be used to further secure the mop. For a forty-eight inch mop, four sections of material can be removed from the roll along a perforation and attached to the mop in a manner similar to the thirty-six inch mop.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

Various features of the invention are set forth in the following claims.

What is claimed is:

1. A mop comprising:

a mop head having a base including a top, a bottom, and a front edge; and a receptacle coupled to the base and in communication with the top of the base; and a debris collecting material coupled to the base, the debris collecting material positioned on a portion of the top of the base, along the front edges of the base, and on a portion of the bottom of the base.

2. The mop of claim 1, wherein the mop head further comprises several projections positioned on the mop head and the debris collecting material further comprises several apertures to be received on the projections.

3. The mop of claim 2, wherein the projections are positioned adjacent the front edge of the base.

4. The mop of claim 3, wherein the projections are positioned on the top of the base.

5. The mop of claim 2, wherein the projections are hook shaped to retain the debris collecting material on the mop head.

6. The mop of claim 1, wherein the base and the receptacle are integrally formed.

7. The mop of claim 1, wherein the receptacle is positioned and configured to capture materials that passes over the mop head while mopping.

8. The mop of claim 7, wherein the receptacle has a wall that extends around a substantial portion of the periphery of the mop head.

9. The mop of claim 8, wherein a central portion of the receptacle defines a recess for collecting debris.

10. The mop of claim 7, wherein the receptacle has first portions that extend substantially from opposite ends of the base and a second portion substantially centrally located relative to the opposite ends, the first portions are configured to direct debris toward the central portion.

11. The mop of claim 10, where the central portion is at least partially covered to form a cavity for receiving and storing debris.

12. The mop of claim 10, wherein the first portions have a first height relative to the base and the second portion has a second height relative to the base that is greater than the first height.

13. A mop comprising:

a mop head having a base including a top, a bottom, and a front edge;

several projections positioned adjacent the front edge of the base;

a receptacle coupled to and positioned adjacent the base, the receptacle having an opening adjacent the front edge for receiving materials; and a debris collecting material coupled to the base, the debris collecting material having several apertures positioned and dimensioned to be received on the projections of the base.

14. The mop of claim 13, wherein the projections are positioned on the top of the base.

15. The mop of claim 13, wherein the projections are hook shaped to retain the debris collecting material on the mop head.

16. The mop of claim 13, wherein the base and the receptacle are integrally formed.

17. The mop of claim 13, wherein the receptacle is positioned and configured to capture materials that passes over the mop head while mopping.

18. The mop of claim 17, wherein the receptacle has a wall that extends around a substantial portion of the periphery of the mop head.

19. The mop of claim 18, wherein a central portion of the receptacle defines a recess for collecting debris.

20. The mop of claim 17, wherein the receptacle has first portions that extend substantially from opposite ends of the base and a second portion substantially centrally located relative to the opposite ends, the first portions are configured to direct debris toward the central portion.

21. The mop of claim 20, where the central portion is at least partially covered to form a cavity for receiving and storing debris.

22. The mop of claim 20, wherein the first portions have a first height relative to the base and the second portion has a second height relative to the base that is greater than the first height.

23. The mop of claim 13, wherein the apertures of the debris collecting material are positioned adjacent an edge of the debris collecting material.

24. The mop of claim 13, wherein the projections are positioned along the front edge of the base.

* * * * *